US006310002B1

(12) United States Patent
Krzoska et al.

(10) Patent No.: US 6,310,002 B1
(45) Date of Patent: Oct. 30, 2001

(54) RECORD MATERIAL

(75) Inventors: Michael Curley Krzoska; Troy Ronald Seehafer, both of Appleton, WI (US)

(73) Assignee: Appleton Papers Inc., Appleton, WI (US)

( * ) Notice: Subject to any disclaimer, the term of this patent is extended or adjusted under 35 U.S.C. 154(b) by 0 days.

(21) Appl. No.: 09/520,909

(22) Filed: Mar. 7, 2000

(51) Int. Cl.[7] ..... B41M 5/136; B41M 5/145; B41M 5/155

(52) U.S. Cl. ..... 503/213; 503/215; 503/218; 503/220; 503/221; 503/225

(58) Field of Search ..... 503/213, 215, 503/216, 218, 220, 221, 225

(56) References Cited

U.S. PATENT DOCUMENTS

| | | | |
|---|---|---|---|
| 2,712,507 | 7/1955 | Green | 117/36 |
| 2,730,457 | 1/1956 | Green et al. | 117/36 |
| 3,016,308 | 1/1962 | Macaulay | 117/36.7 |
| 4,001,140 | 1/1977 | Foris et al. | 252/316 |
| 4,087,376 | 5/1978 | Foris et al. | 252/316 |
| 4,089,802 | 5/1978 | Foris et al. | 252/316 |
| 4,100,103 | 7/1978 | Foris et al. | 252/316 |
| 4,552,811 | 11/1985 | Brown et al. | 428/402.21 |
| 5,126,390 | 6/1992 | Duff | 524/276 |
| 5,177,051 | 1/1993 | Hobson et al. | 503/209 |
| 5,281,266 | 1/1994 | Sheiham et al. | 106/311 |
| 5,464,803 | 11/1995 | McGuinness et al. | 503/213 |
| 5,472,489 | 12/1995 | Sheiham et al. | 106/311 |
| 5,476,829 | 12/1995 | Taylor et al. | 503/201 |
| 5,605,874 | 2/1997 | Taylor et al. | 503/201 |
| 5,741,447 | 4/1998 | Bond | 264/4 |
| 5,880,064 | 3/1999 | Kagota et al. | 50/213 |

OTHER PUBLICATIONS

The Six International Congress on Advances in Non–Impact Printing Technologies.

*Primary Examiner*—Bruce H. Hess
(74) *Attorney, Agent, or Firm*—Benjamin Mieliulis

(57) ABSTRACT

A novel pressure sensitive record material suitable for use for high temperature reprographic equipment is disclosed comprising a sheet support carrying isolated droplets of an oil solution of chromogenic material, said isolated droplets being confined within respective pressure rupturable barriers, and, on the opposite surface of the same sheet or on a different sheet support, a coating of a acidic developer material effective to develop the color of the chromogenic material in solution on contact, wherein, the pressure rupturable barrier comprises microcapsules having a wall material formed from polymerization of melamine and formaldehyde, methylol melamine methylated methylol melamine, urea and formaldehyde, dimethylol urea or methylated dimethylol urea, with a copolymer of acrylic acid and alkyl acrylate; the oil solution comprises a blend of (i) a vegetable oil having a degree of unsaturation greater than 30% such as canola oil, soybean oil, corn oil, sunflower oil, or cottonseed oil with (ii) alkyl esters of fatty acids derived from transesterification of the same or different vegetable oils such as a canola oil, soybean oil, corn oil, sunflower oil, or methyl ester of oleic acid, and (iii) straight chain saturated paraffinic aliphatic hydrocarbons of from 10 to 13 carbons. The disclosed pressure sensitive record material is suitable for use in high temperature reprographic environments.

21 Claims, No Drawings

RECORD MATERIAL

BACKGROUND OF THE INVENTION

1. Field of the Invention

This invention relates to carbonless record materials. It more particularly relates to pressure-sensitive recording materials in the form of multi-ply carbonless record sheets and rolls. Such recording materials include colorless but colorable components, known as chromogenic materials, isolated to prevent coloration until the components are brought together.

Pressure sensitive recording materials, or carbonless papers, are mark forming systems and can be comprised of various arrangements of the mark-forming components and minute droplets of encapsulated solvent which, upon pressure release bring the mark-forming components into reactive contact. Many of these configurations are depicted in U.S. Pat. No. 3,672,935, which is hereby incorporated by reference. The most widely used configuration commercially is depicted in FIG. 2, view III, of said patent. In such a configuration the underside of the top sheet (the coated back or CB sheet) of a two-ply system is coated with a microcapsule layer wherein the microcapsules contain a solvent solution of chromogenic material, commonly called the colorformer. The top side of the bottom sheet (the coated front or CF sheet) is coated with a layer comprising developer material. To the uncoated side of the CF sheet can also be applied microcapsules containing a solution of color formers resulting in a pressure-sensitive sheet which is coated on both the front and back sides (hereinafter referred to as a CFB sheet). When said plies are superimposed, one on the other, in such a manner that the microcapsules of one ply are in proximity with the color developers of the second ply, the application of pressure, as by a writing instrument or impact printer, sufficient to rupture the microcapsules, releases the solution of color former and transfers color former solution to the CF sheet resulting in image formation through reaction of the color former solution with the color developer.

In a variation of the above-described arrangement, the solution of chromogenic material may be present as isolated droplets in a continuous pressure-rupturable matrix instead of being contained within discrete pressure-rupturable microcapsules.

In another type of pressure-sensitive carbonless system, known as a self-contained system, microcapsules and acidic color developer material are coated onto the same surface of a sheet, and writing or impact printing on a sheet placed above the thus-coated sheet causes the microcapsules to rupture and release the solution of chromogenic material, which then reacts with the color developer material on the sheet to produce a colored mark.

2. Description of Related Art

Vegetable oils have been identified as possible alternative solvents in pressure sensitive recording materials or carbonless papers. See for example U.S. Pat. Nos. 2,712,507; 2,730,457; 3,016,308; 4,001,140; 4,089,802. More recent examples of such vegetable oil based solvent systems for pressure sensitive recording materials include U.S. Pat. Nos. 5,177,051; 5,281,266; 5,464,803; 5,472,489; 5,476,829; and 5,605,874.

Despite these disclosures, it is only recently that some of these vegetable oil systems have been commercialized principally in some European countries, responding to market perceptions of a consumer preference for natural based systems.

Commercial acceptance of such recording systems in the United States has been slower due to drawbacks of many of these pressure sensitive recording materials relating to smudge, premature capsule breakage, odor and the ability to deliver images of sufficient intensity.

Additionally, vegetable and vegetable based oils are notably poor solvents. Although this can be an obvious advantage in certain environments, such as in contact with rubber or plastic printer components, nonetheless vegetable oil solvents are problematic requiring elevated temperatures such as 140° C. to effect colorformer dissolution in the solvents. The vegetable oil solvents additionally can give rise to processing difficulties in achieving sufficiently small, less than 6 micron capsule sizes. It is an object of the present invention to disclose a novel carbonless paper especially suited for high temperature reprographic equipment environments such as xerographic machines, toner based copiers, laser printers and the like. This type of equipment often includes elements such as heated transfer rolls, fuser rolls, photoreptors, electronically charged drums or cylinders and other mechanical rollers, drums and other parts often operating at elevated temperatures. Since such machines can operate in enclosed facilities, minimizing odors is desirable.

The operating temperatures of such devices require specialized papers meeting stringent requirements for optimal performance.

A carbonless paper suitable for processing in elevated temperature reprographic equipment and achieving more intense imaging would be an advance in the art.

DETAILED DECRIPTION

The present invention discloses an improved pressure sensitive record material suitable for elevated temperature reprographic equipment. Reprographics equipment includes xerographic copiers, laser printers, toner-based copiers, electrostatic reproduction devices and the like. The pressure-sensitive record material, or carbonless paper, of the invention is particularly suitable for reprographic equipment operations at elevated temperatures.

The pressure sensitive record materials suitable for elevated temperature reprographic equipment comprises a sheet support carrying a pressure rupturable barrier microcapsules containing an oil solution of a chromogenic material, and, on either surface, but preferably the opposite surface of the same sheet or on a different sheet support, a coating of an acidic developer material effective to develop the color of the chromogenic material in solution on contact therewith.

Furthermore, the pressure rupturable barrier comprises microcapsules having a wall material formed from polymerization of melamine and formaldehyde, methylol melamine, methylated methylol melamine, urea and formaldehyde, dimethylol urea or methylated dimethylol urea, with a copolymer of acrylic acid and alkyl acrylate. The oil solution comprises a blend of vegetable oil, having a degree of unsaturation greater than 30% and alkyl esters of fatty acids derived from of transesterification vegetable oil, and straight chain saturated paraffinic aliphatic hydrocarbons. The vegetable oil preferably is comprised substantially of fatty acids of from 14 to 18 carbons each. More preferably, the oil solution comprises a blend of (i) a vegetable oil preferably selected from canola oil, soybean oil, corn oil, sunflower oil, or cottonseed oil with (ii) methyl esters of fatty acids derived from transesterification of canola oil, soybean oil, cottonseed oil, corn oil, sunflower oil, or methyl ester of oleic acid, and (iii) straight chain saturated paraffinic aliphatic hydrocarbons of from 10 to 13 carbons.

TABLE 1

| Oil | % Unsaturated |
|---|---|
| Almond | 87.3 |
| Canola | 88.5 |
| Corn | 82.9 |
| Cottonseed | 69.7 |
| Hazelnut | 88.2 |
| Olive | 82.1 |
| Peanut | 78.2 |
| Safflower | 33.0 |
| Sesame | 81.4 |
| Soybean | 81.2 |
| Sunflower | 42.2 |

Table 1 provided levels of % unsaturation of some common vegetable oils.

Methods to form microcapsules, starting materials and procedures are described in U.S. Pat. Nos. 4,001,140; 4,087,376; 4,089,802; 4,100,103; and 4,552,811 which are hereby incorporated by reference. The process of U.S. Pat. No. 4,552,811 was preferred.

The microcapsules of the record system of the invention have wall material formed from polymerization of melamine and formaldehyde, methylol melamine, and methylated methylol urea, with a polyacrylic acid or a copolymer of acrylic acid and an alkyl acrylate. The alkyl acrylate can be selected such that the alkyl moiety is from about one to twelve and preferably from one to eight carbons. Examples of such alkyl acrylates include methyl acrylate, ethyl acrylate, propyl acrylate, butyl acrylate, pentyl acrylate, hexylacrylate, cyclohexyl acrylate, 2-ethylhexyl acrylate and the like. A preferable copolymer was 90% polyacrylic acid and 10% butyl acrylate.

The polyacrylate microcapsules of the invention together with the solvent oil solution blend is surprisingly especially suited for elevated temperature reprographic environments. Commercial systems using any type of natural oil in the solvent mix almost exclusively rely on gelatin based capsules. Such capsule systems however tend to form agglomerates, and have less uniform capsule distribution, and some of such capsules are prone to premature rupture attributable to a far lesser degree of capsule uniformity.

The record system of the invention relying on the combination of polyacrylate based capsules with a solvent blend of vegetable oils having a degree of unsaturation of 30%, alkyl esters preferably methyl and ethyl esters of fatty acids derived from transesterification of a vegetable oil, such as canola, soybean, cottonseed, corn, or sunflower oil, together with a paraffinic aliphatic hydrocarbon solvent, yields a surprising improved carbonless system for elevated temperature environments such as reprographic equipment. The synthetic capsules are more uniform, and durable enabling meeting of stringent performance requirements.

The oil solution blend is comprised of vegetable oil at 10 to 70 weight percent, alkyl ester of fatty acids at 20 to 80 weight percent, and the paraffinic hydrocarbons at from 0.5 to 70 weight percent.

The alkyl esters of fatty acids are synthesized by a process of transesterification. Free fatty acids in a mixed triglyceride sample of vegetable oil are neutralized with a base, glycerin is removed, and an alcohol ester is created. The alkaline metal alkoxide such as sodium methoxide (made from mixing NaOH with methanol) is mixed into the vegetable oil. The entire mixture then settles. Glycerin is left on the bottom and the alkyl esters, such as methyl esters are left on top. The base is not limited to NaOH. Any base that is a stronger base than the alkoxide can be used.

Fatty acid methyl esters, for example, are produced from the acid- or alkali-catalyzed reaction of vegetable oil triglycerides with a lower alcohol such as methanol. These have value for use as a bio-diesel fuel, for use in cosmetics, for surfactant production by sulfonation, and numerous other applications. Originally, the process was used for the production of high-grade glycerol. As a continuous process or in large-scale batch processes, the transesterification is normally alkali-catalyzed because this reaction is faster than the acid-catalyzed reaction.

The process is diagramed as follows: $R_1$, $R_2$ and $R_3$ are alkyl groups.

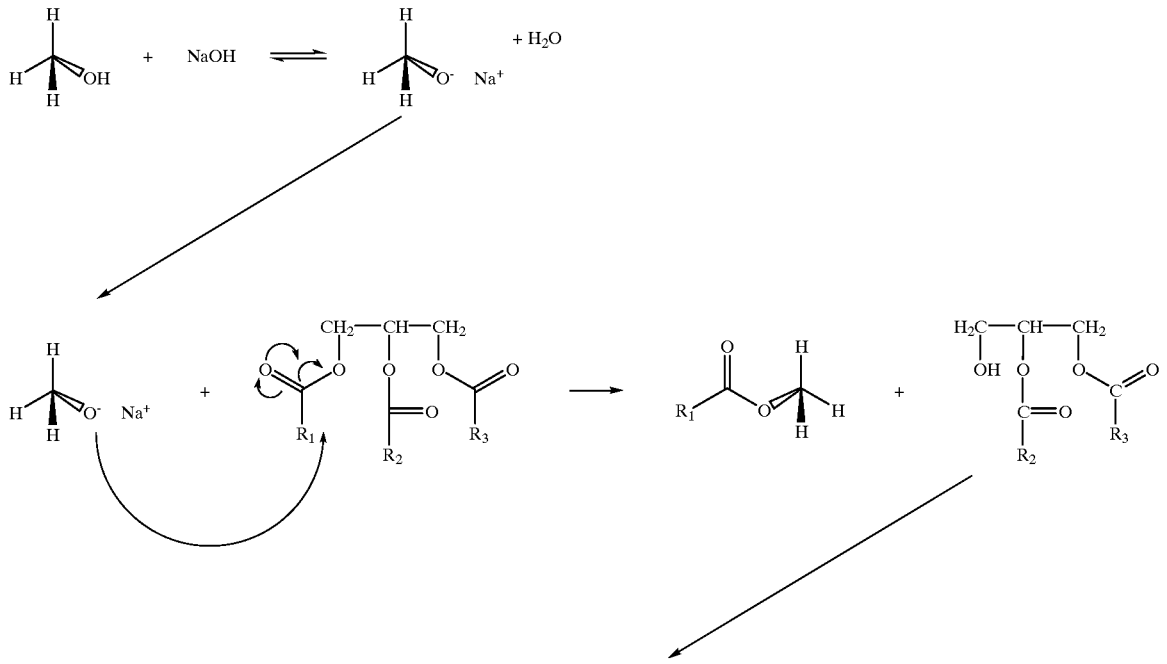

-continued

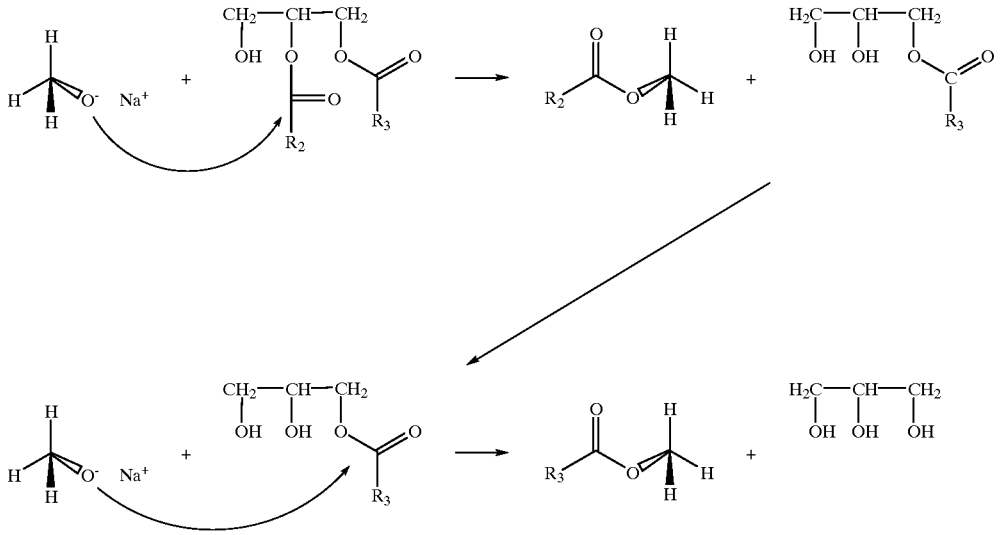

Methyl esters of fatty acids are available commercially such as through Lam bent Technologies, Skokie, Ill., or Columbus Foods Company, Chicago, Ill.

A method of transesterification of vegetable oil is also described in P. De Filippis, C. Giavarini, M. Scarsella and M. Sorrentino "Transesterification Processes for Vegetable Oils: A Simple Control Method of Methyl Ester Content," *Journal of The American Oil Chemists' Society*, Vol. 72, No. 11 (1995).

The paraffinic hydrocarbons useful in the invention are aliphatic hydrocarbons. Preferred are paraffinic hydrocarbons that are straight chain saturated hydrocarbons. Preferably the paraffinic hydrocarbons are of C-10 to C-13 in carbon chain length. An example of this type of hydrocarbon is Norpar 12, a trademark of the Exxon Corporation. Norpar 12 is a narrow-cut 188°–217° C. (370°–422° F.) boiling range, normal-paraffinic liquid solvent composed primarily of 13% C-10, 36% C-11, 44% C-12 and 7% C-13. Norpar 12 exhibits a flashpoint temperature of 69° C.

The chromogenic materials are electron donating dye precursors also known as colorformers. These colorformers include phthalide, leucauramine and fluoran compounds. Chromogenic materials include Crystal Violet Lactone (3,3-bis(4-dimethylaminophenyl)-6-dimethylaminophthalide, U.S. Pat. No. RE. 23,024); phenyl-, indol-, pyrrol- and carbazol-substituted phthalides (for example, in U.S. Pat. Nos. 3,491,111; 3,491,112; 3,491,116; 3,509,174); nitro-, amino-, amido-, sulfonamido-, aminobenzylidene-, halo-, anilino-substituted fluorans (for example, in U.S. Pat. Nos. 3,624,107; 3,627,787; 3,641,011; 3,642,828; 3,681,390); spiro- dipyrans (U.S. Pat. No. 3,971,808); and pyridine and pyrazine compounds (for example, in U.S. Pat. Nos. 3,775,424 and 3,853,869). Other eligible chromogenic materials include: 3-diethylamino-6-methyl-7-anilino-fluoran (U.S. Pat. No. 3,681,390); 2-anilino-3-methyl-6-dibutylamino-fluoran (U.S. Pat. No. 4,510,513) also known as 3-dibutylamino-6-methyl-7-anilino-fluoran; 3-dibutylamino-7-(2-chloroanilino)fluoran; 3-(N-ethyl-Ntetrahydrofurfurylamino)-6-methyl-7-3-5'6-tris(dimethylamino)spiro[9H-fluorene-9'1 (3'H)isobenzofuran]-3'-one; 7-(1-ethyl-2-methylindol-3-yl)-7-(4-diethylamino-2-ethoxyphenyl)-5, 7-dihydrofuro[3,4-b]pyridin-5-one (U.S. Pat. No. 4,246,318); 3-diethylamino-7-(2-chloroanilino) fluoran (U.S. Pat. No. 3,920,510); 3-(N-methylcyclohexylamino)-6-methyl-7-anilino-fluoran (U.S. Pat. No. 3,959,571); 7-(1-octyl-2-methylindol-3-yl)-7-4-(4-diethylamino- 2-ethoxy-phenyl)-5,7-dihydrofuro [3,4-b] pyridin-5-one; 3-diethylamino-7,8-benzofluoran; 3,3-bis(1-ethy-2-methylindol-3-yl) phthalide; 3-diethylamino-7-anilino-fluoran; 3-diethylamino-7-benzylaminofluoran; 3'-phenyl-7-dibenzylamino-2,2'-spiro-di-[2H-1-benzopyran]; 6'[ethyl(3-methylbutyl)amino]-3'-methyl-2'(phenylamino)-spiro[isobenzofuran-1(3H),9'-[9H]xanthen]-3-one; 6-(dimethylamino-3,3-bis(4-(dimethylamino) phenyl)-1(3H)-isobenzofuranone (crystal violet lactone); 3-diethylamino-6-methyl-7-(2,4-dimethylphenyl) aminofluoran and mixtures of any of the foregoing. The or β crystalline forms, of some of the fluourans, where such are known, are equally functional, and equivalent for purposes of this invention.

Employing the oil solution solvent blend of the invention, the colorformers are surprisingly and desirably able to be dissolved at reduced temperatures of less than 100° C.

In a preferred embodiment, the chromogenic materials 3-diethylamino-6-methyl-7-(2',4-'dimethylanilino) fluoran, 6'-[ethyl (3-methylbutyl) amino]-3'-methyl-2'-(phenylamino)-spiro [isobenzofuran-1(3H), 9'-[9H] xanthen]-3-one, and 3'-chloro-6'-cyclohexylamino-[isobenzofuran-1 (3H), 9'-[9H] xanthen]-3-one were dissolved in methyl ester of canola oil at from 90 to 98° C. These lower temperatures of dye dissolution were particularly favored and significantly less than dissolution temperatures for other vegetable based capsule systems taught in the art.

The color developer can be an inorganic color developer. Such color developers are inorganic acid minerals such as montmorillonite, for example as disclosed in British Patent No. 1213835; colloidal silica, kaolin, bentonite, attapulgite, silton clay, hallosyte, and the like. The acid mineral materials are preferred as they do not melt but undergo color reaction on fusion of the chromogenic. Alternatively, or in addition, other acid clays may be used, as can so-called semi-synthetic inorganic developers as disclosed for example, in European Patent Applications Nos. 44645 and 144472A, or alumina/silica colour developers such as disclosed in European Patent Applications Nos. 42265A, 42266A, 434306A, or 518471A.

Other acidic developer material include the compounds listed in U.S. Pat. No. 3,539,375 as phenolic reactive material, such as monophenols and diphenols. Acidic developer materials also include, the following compounds which may be used individually or in mixtures: 4,4'-isopropylidinediphenol (Bisphenol A); p-hydroxybenzaldehyde; p-hydroxybenzophenone; phydroxypropiophenone; 2,4-dihydroxyacetophenone; 4-hydroxy-4'-methylbenzophenone; 4,4'-dihydroxybenzophenone; 2,2-bis(4-hydroxyphenyl)-4-methylpentane; benzyl 4-hydroxyphenyl ketone; 2,2-bis(4-hydroxyphenyl)-5-methyl-hexane; ethyl-4-,4-bis(4-hydroxyphenyl)-pentanoate; isopropyl-4,4-bis(4-hydroxyphenyl) pentanoate; methyl-4,4-bis (4-hydroxyphenyl) pentanoate; allyl-4,4-bis (4-pentane; 4,4-bis(4-hydroxyphenyl)-heptane; 2,2-bis (4-hydroxyphenyl)-1-phenylpropane; 2,2-bis (4-hydroxyphenyl) butane; 2,2'-methylene-bis(4-ethyl-6-tertiarybutyl phenol); 4-hydroxycoumarin; 7-hydroxy-4-methyl-coumarin; 2,2'-methlene-bis (4-octyl phenol); 4,4-'-sulfonyldiphenol; 4,4-'-thiobis (6-tertiarybutyl-m-cresol); methyl-p-hydroxybenzoate; n-propyl-p-hydroxybenzoate; benzyl-p-hydroxybenzoate; 4,4-'-isopropylin-dinediphenol, n-propyl-4,4-bis (4-hydroxyphenyl) pentanoate, isopropyl-4,4-bis(4-hydroxyphenyl) pentanoate, methyl 4,4-bis (4-hydroxyphenyl) pentanoate, 2,2-bis(4-hydroxyphenyl)-4-4-methylpentane, phydroxybenzophenone, 2,4-dihydroxybenzophenone, 1,1-bis(4-hydroxyphenyl) cyclohexane, and benzyl-p-hydroxybenzoate. Acidic developer material can also include phenolic novolak resins which are the product of reaction between, for example, formaldehyde and a phenol such as an alkylphenol, e.g., p-octylphenol, or other phenols such as p-phenylphenol, and the like.

Examples of eligible acidic developer material also include: clays, treated clays (U.S. Pat. Nos. 3,622,364 and 3,753,761); aromatic carboxylic acids such as salicylic acid; derivatives of aromatic carboxylic acids and metal salts thereof (U.S. Pat. No. 4,022,936); phenolic developers (U.S. Pat. Nos. 3,244,550 and 4,573,063); acidic polymeric material such as phenol-formaldehyde polymers, etc. (U.S. Pat. Nos. 3,455,721 and 3,672,935); and metal-modified phenolic resins (U.S. Pat. Nos. 3,732,120; 3,737,410; 4,165,102; 4,165,103; 4,166,644 and 4,188,456). Image enhancement by inclusion of metallic salts of carboxylic acids, such as use of zinc salicylate, can be optionally employed.

The record material includes a sheet support material. For purposes of this invention sheets are understood to also mean webs, rolls, ribbons, tapes, belts, films, cards and the like.

Sheets denote articles having two large surface dimensions and a comparatively small thickness dimension. The sheet support material can be opaque, transparent or translucent and could, itself, be colored or not. The sheet support material preferably is fibrous and preferably paper or paper and filamentous synthetic materials. It can be a film including, for example, synthetic polymeric sheets.

The sheet support material on which the components of the system are disposed may comprise a single or dual sheet assembly. In the case where all components are disposed on a single sheet, the record material is referred to as a "self-contained" system. Where there must be a migration of the solvent, with or without mark-forming component, from one sheet to another, the record materials is referred to as a "transfer" system. Such a system may also be referred to as a "couplet" system, in that at least two sheets are required and each sheet includes a component, or components, essential to the mark-forming reaction.

The thickness of the present paper (before microcapsule coating) may be as is conventional for carbonless paper, for example the thickness may be about 60 to 90 microns and the weight about 35 to 50 $gm^{-2}$, or higher, such as up to about 100 $gm^{-2}$ or higher. The weight depends to some extent on the intended final use. The higher weight just are normally applicable to CB papers for special applications.

Microcapsules may be present in the sheet support material either disposed therethroughout or as a coating thereto, or both. The capsules may be applied to the sheet material while still dispersed in the liquid vehicle in which they were manufactured, or, if desired, separated and the separated capsules thereafter dispersed in a solution of the polymeric component to form a coating composition in which, because of incompatibility of the solution and the capsules, both retain their identity and physical integrity. When this composition is disposed as a film on the support material and dried, the capsules are held therein by binders subject to rupture to release the liquid contained. This latter technique, relying on the incompatibility of the microcapsule and the dispersing medium of the film-forming mark-forming component, allows for a method of preparing a sensitive record coating with the capsules interspersed directly in a film of polymeric material as it is laid down from solution. A further alternative is to disperse in a liquid medium one or more mark-forming components, insoluble therein, and disperse in said medium the insoluble microcapsules, with the result that all components of the mark-forming system may be disposed on or within the support sheet. Obviously, the several components may be applied individually.

The respective amounts of the several components will vary, depending primarily upon the nature of the materials and the architecture of the record material unit. Suitable amounts include, in the case of the chromogenic material, 0.03 to 0.075 pound (13.6 g. to 34.01 g.) per ream (a ream in this application meaning five hundred sheets of 25"×38" approx. (63.5 cm×96.5 cm) paper, totaling 3,300 square feet (306.57 sq. meters)), the preferred amount being 0.05 pound (22.6 g.) per ream; in the case of the solvent, 1 to 3 pounds (453 g. to 1360 g.) per ream; and in the case of the polymer, ½ to 3 pounds (226 g. to 1360 g.) per ream. The upper limit is primarily a matter of economic consideration.

In forming a coating slurry of microcapsules, additives for example stilt materials such as wheat starch, corn starch, or hollow or filled particulates can be included. Pigments such as calcium hydroxide, titanium oxide, calcium carbonate and talc can be employed. Other additives can include surfactants, preservatives, foam control materials, UV stabilizers and fillers.

Optionally, filler material particles may be used such as granular starch particles, cellulose fibers, polymer material fibers, granules, hollow glass microspheres, expanded or unexpanded polymer micro-beads, sawdust, woodflour and other insoluble micro-fine particles, a large number of which are available in nature and commerce. The filler materials should be particulate, minute, and relatively insoluble but suspendable in the slurry vehicle.

Binder material can be included to assist adherence of the capsules to the substrate and can include materials such as polyvinyl alcohol, hydroxy ethylcellulose, methylcellulose, methyl-hydroxypropylcellulose, starch, modified starches, latex such as polyacrylate, styrenebutadiene, rubber latex, polyvinylacetate and polystyrene.

The coating can be applied by means of an air knife coater, blade coater, rod coater, flexo coater, curtain coater and the like. Coat weights approximately in the area of 2 to 5 pounds (9.1 to 2.3 kg.) per ream are typical. The coating is formulated such that it comprises from 10 to 75 parts by weight, on a dry solids basis, of microcapsules.

The examples which follow are given to illustrate the invention and should not be considered as limiting. In the examples all parts or proportions are by weight and all measurements are in the metric system, unless otherwise stated.

COMPARATIVE SYSTEMS

Polyacrylate comparative capsule systems were prepared using 50% by weight of various vegetable oils with 50% by weight of various alkyl esters as illustrated in Table 2.

Such systems provided improvement in some properties but not sufficient Kubelka Munk intensity to be viable commercially or yield capsule systems with unacceptably high permeabilities resulting in premature discoloration. The best balance and consistent improvement in properties of print speed and intensity as reflected in % ultimate Kubelka Munk values was surprisingly achievable only with addition of 0.5 to 70 weight percent of paraffinic hydrocarbons to the oil solution to form the unique oil solution blend of the invention.

TABLE 2

| Oil | Alkyl Ester | Final Size Microns | TI 2 Minute Average | TI 24 Hour Average | TI % Ultimate K.M. | Print Speed 2 Minute Average | Print Speed 24 Hour Average | Print Speed % Ultimate K.M. | % Permeability |
|---|---|---|---|---|---|---|---|---|---|
| Canola Oil | Oleic Acid Methyl Ester | 4.95 | 47.9 | 38.0 | 56.0 | 48.3 | 35.9 | 48.4 | 2.47 |
| Winterized Cottonseed Oil | Sunflower Oil Methyl Ester | 4.70 | 49.7 | 38.9 | 53.0 | 49.1 | 37.1 | 49.5 | 2.45 |
| Winterized Cottonseed Oil | Soybean Oil Methyl Ester | 5.12 | 41.8 | 32.7 | 58.5 | 45.7 | 34.8 | 52.8 | 3.45 |
| Winterized Cottonseed Oil | Oleic Acid Methyl Ester | 5.01 | 46.1 | 36.0 | 55.4 | 49.6 | 37.5 | 49.2 | 2.45 |
| Canola Oil | Sunflower Oil Methyl Ester | 4.60 | 46.1 | 36.2 | 56.0 | 50.3 | 38.4 | 49.7 | 37.56 |
| Non-Winterized Cottonseed Oil | Soybean Oil Methyl Ester | 4.67 | 52.1 | 41.8 | 54.3 | 56.2 | 42.9 | 44.9 | 5.76 |
| Non-Winterized Cottonseed Oil | Sunflower Oil Methyl Ester | 4.38 | 56.5 | 45.8 | 52.2 | 59.7 | 46.5 | 44.2 | 4.33 |
| Non-Winterized Cottonseed Oil | Oleic Acid Methyl Ester | 5.01 | 51.3 | 41.1 | 54.8 | 49.7 | 37.9 | 50.0 | 4.20 |
| Corn Oil | Soybean Oil Methyl Ester | 4.66 | 47.2 | 37.7 | 57.4 | 51.0 | 39.1 | 49.6 | 4.94 |
| Canola Oil | Soybean Oil Methyl Ester | 4.62 | 52.3 | 41.9 | 54.0 | 53.9 | 41.7 | 48.4 | 3.80 |
| Soybean Oil | Oleic Acid Methyl Ester | 5.01 | 48.4 | 38.9 | 57.3 | 50.6 | 38.9 | 50.3 | 3.37 |
| Corn Oil | Sunflower Oil Methyl Ester | 4.96 | 42.0 | 32.7 | 57.8 | 44.0 | 33.8 | 55.0 | 4.47 |
| Soybean Oil | Sunflower Oil Methyl Ester | 5.10 | 40.3 | 32.0 | 61.2 | 44.2 | 33.1 | 52.1 | 5.50 |
| Corn Oil | Oleic Acid Methyl Ester | 5.02 | 43.1 | 33.7 | 57.6 | 46.6 | 34.5 | 49.2 | 2.28 |
| Soybean Oil | Soybean Oil Methyl Ester | 4.70 | 48.8 | 38.3 | 54.0 | 49.3 | 37.9 | 51.2 | 2.25 |
| Winterized Cottonseed Oil | Canola Oil Methyl Ester | 4.82 | 42.5 | 33.5 | 58.9 | 47.0 | 35.4 | 50.7 | 2.50 |
| Corn Oil | Canola Oil Methyl Ester | 4.92 | 39.6 | 31.0 | 60.0 | 38.8 | 29.9 | 58.7 | 30.18 |
| Canola Oil | Canola Oil Methyl Ester | 4.98 | 36.8 | 28.6 | 60.9 | 41.3 | 30.9 | 54.0 | 26.46 |
| Non-Winterized Cottonseed Oil | Canola Oil Methyl Ester | 4.55 | 47.8 | 37.5 | 54.7 | 51.7 | 39.0 | 47.3 | 3.69 |
| Soybean Oil | Canola Oil Methyl Ester | 4.44 | 44.2 | 34.6 | 57.0 | 45.0 | 34.1 | 52.8 | 2.21 |

TABLE 3

| | % Dry |
|---|---|
| **Capsule System A** | |
| Internal Phase | |
| Colorformers: | |
| 3'chloro-6'-cyclohexylamino-spiro[isobenzofuran-1(3H), 9'-[9H]xanthen]-3-one | 1.58% |
| 6'-[ethyl(3-methylbutyl)amino]-3'-methyl-2-'(phenylamino)-spiro[isobenzofuran-1(3H), 9'-[9H]xanthen]-3-one | 2.50% |
| 3-Diethylamino-6-methyl-7-(2,4-dimethylphenyl)aminofluouran | 1.11% |
| Solvents | |
| Soybean Oil | 26.83% |
| Canola Oil Methyl Ester | 39.21% |
| Normal Paraffinic Hydrocarbons (Norpar 12 Solvent) | 16.51% |

TABLE 3-continued

| | % Dry |
|---|---|
| Aqueous Phase I | |
| Acrylic Copolymer (Colloid 351) | 2.11% |
| NaOH | 0.32% |
| Melamine-Formaldehyde Resin (Cymel 385) | 1.08% |
| Aqueous Phase II | |
| Acrylic Copolymer (Colloid 351) | 1.76% |
| 20% NaOH | 0.01% |
| Melamine-Formaldehyde Resin (Cymel 385) | 5.93% |
| Salt | |

TABLE 3-continued

| | % Dry |
|---|---|
| $Na_2SO_4$ | 1.06% |
| **Capsule System B** | |
| Internal Phase | |
| Colorformers: | |
| 3-Diethylamino-6-methyl-7-(2,4-dimethylphenyl)aminofluoran | 1.58% |
| 6'-[ethyl(3-methylbutyl)amino]-3'-methyl-2'-(phenylamino)-spiro[isobenzofuran-1(3H), 3'-[9H]xanthen]-3-one | 2.50% |
| 2-anilino-3-methyl-6-dibutylaminofluoran | 1.11% |
| Solvents | |
| Soybean Oil | 26.83% |
| Canola Oil Methyl Ester | 39.21% |
| Normal Paraffinic Hydrocarbons | 16.51% |

TABLE 3-continued

| | % Dry |
|---|---|
| Aqueous Phase I | |
| Acrylic Copolymer (Colloid 351) | 2.11% |
| NaOH | 0.32% |
| Melamine-Formaldehyde Resin (Cymel 385) | 1.08% |
| Aqueous Phase II | |
| Acrylic Copolymer (Colloid 351) | 1.76% |
| 20% NaOH | 0.01% |
| Melamine-Formaldehyde Resin (Cymel 385) | 5.93% |
| Salt | |
| $Na_2SO_4$ | 1.06% |
| Capsule System C | |
| Internal Phase | |
| Colorformers: | |
| 3-Diethylamino-6-methyl-7-(2,4-dimethylphenyl)aminofluoran | 1.66% |
| 6'-[ethyl(3-methylbutyl)amino]-3'-methyl-2'(pheylamino)-spiro[isobenzofuran-1(3H), 3'-[9H]xanthen]-3-one | 2.50% |
| Solvents | |
| Soybean Oil | 26.83% |
| Canola Oil Methyl Ester | 39.21% |
| Normal Paraffinic Hydrocarbons | 16.51% |
| Aqueous Phase I | |
| Acrylic Copolymer (Colloid 351) | 2.11% |
| NaOH | 0.32% |
| Melamine-Formaldehyde Resin (Cymel 385) | 1.08% |
| Aqueous Phase II | |
| Acrylic Copolymer (Colloid 351) | 1.76% |
| 20% NaOH | 0.01% |
| Melamine-Formaldehyde Resin (Cymel 385) | 5.93% |
| Salt | |
| $Na_2SO_4$ | 1.06% |
| Capsule System D | |
| Internal Phase | |
| Colorformers: | |
| 6'-[ethyl(3-methylbutyl)amino]-3-methyl-2'(phenylamino)-spiro[isobenzofuran-1(3H), 9'-[9H]xanthen]-3-one | 1.50% |
| Chrystal Violet Lactone | 1.50% |
| 3-Dibutylamino-6-methyl-7-(2',4'-dimethylanilino)fluoran | 1.50% |
| 3-Diethylamino-6-methyl-7-(2,4-dimethylphenyl)aminofluouran | 1.50% |
| Solvents | |
| Soybean Oil | 24.49% |
| Canola Oil Methyl Ester | 40.82% |
| Normal Paraffinic Hydrocarbons | 16.51% |
| Aqueous Phase I | |
| Acrylic Copolymer (Colloid 351) | 2.12% |
| NaOH | 0.33% |
| Melamine-Formaldehyde Resin (Cymel 385) | 1.09% |
| Aqueous Phase II | |
| Acrylic Copolymer (Colloid 351) | 1.78% |
| 20% NaOH | 0.01% |
| Melamine-Formaldehyde Resin (Cymel 385) | 5.99% |
| Salt | |
| $Na_2SO_4$ | |

EXAMPLE 1

Capsule Preparation

In a jacketed reactor, Colloid 351, caustic, and deionized water were combined and heated to 65° C. while mixing. The target pH for the first aqueous phase was 5.65–5.75. Referring to Table 3, the colorformers were dissolved in a vegetable oil methyl ester in a jacketed first container at approximately 100° C. The second aqueous phase was prepared by combining Colloid-351, caustic, and deionized water in a second container able to contain all of the second aqueous phase. The second aqueous phase was then mixed and allowed to sit at room temperature until needed. The target pH for the second aqueous phase was 4.40–4.55. Once the dyes had completely dissolved, a mixture of soybean oil and Norpar-12 (normal paraffin) was added to the first container, which, after the addition, reduced the temperature of the internal phase (IP) to ~80° C. The IP was allowed to cool to ~75° C., at which point melamine formaldehyde resin (Cymel 385) was then added to the reactor containing the preheated first aqueous phase. Four minutes after the Cymel 385 addition, the IP was added to the reactor over ~8 minutes. After this time, the milling was started at 1150 fpm (mill speed can range from 1000 fpm to 1250 fpm, depending on desired capsule size, solvent ratio, solvent type and colorformer mass) and continued for 30 minutes. At the completion of the 30 minutes, the milling was stopped while the agitation continued. The Cymel 385 was then added to the second water phase and allowed to mix for approximately 10 minutes before addition to the reactor. 500 g of $Na_2SO_4$ was then added to the reactor. The batch was then allowed to mix with agitation for 8 hours at 65° C., at which point the heat was discontinued. Thereafter, the batch was diluted and neutralized with $NH_4OH$ to pH 7.5–8.25.

Capsule sizes ranged from 4 $\mu$m to 5.8 $\mu$m, dependent primarily on milling speed. Canola oil methyl ester solvated the dyes at about 100° C. Soybean Oil was the primary diluent. Normal paraffinic hydrocarbons (Norpar 12) was the secondary diluent. $Na_2SO_4$ was added to maintain lower viscosity. Capsules were tested by coating on base paper and performing impact tests by which the paper with the capsules was placed on a sheet with a clay color forming coated front. Impact on the CB sheet caused the capsules on the back side to rupture and release the encapsulated solvated dyes, which reacted with the colorforming clay on the surface of the CF. This reaction exposes the dyes and an image is formed on the CF sheet where the impact occurred. These coatings varied by weight and were in the range of 2.5 pounds per ream to 4.0 pounds per ream.

(Colloid 351 is a trademark of Rhone-Poulenc for an acrylic butyl-acrylate copolymer. Cymel is a trademark of American Cyanamid. Cymel 385 is an etherified methyol melamine oligomer.)

Alkylesters

Alkylester of fatty acid can be purchased commercially. Alternatively it can be obtained by known preparations. Methyl ester, for example, of fatty acids of vegetable oil (also known as methyl ester vegetable oil) used in the examples was purchased from Lambent Technologies, Skokie, Ill.

A method of preparation is as follows. In separate container mix 600 g methanol (MeOH) (or 17.2% by volume= 750 ml) with 40 g of NaOH until the NaOH dissolves.

This combined mixture makes sodium methoxide, and is added to the vegetable oil and mixed for 40–60 minutes. Isopropyl alcohol can be added to the vegetable oil to facilitate dissolution.

Draw out samples to check the rate of separation. Glycerine will sink to the bottom and the methyl esters of the fatty acids of the vegetable oil—a translucent liquid, will remain on top. When the separation appears not to be advancing any more, stop mixing. Let the mixture settle for at least 8 hours. The fluid on top is methyl ester vegetable oil, but before using it, remove any remaining soaps or salts. The glycerine which has sunk to the bottom should be separated.

The esterified vegetable oil is decanted into a separate clean container and washed free of any remaining soaps, salts or free fatty acids.

Water is added to the methyl ester vegetable oil, stirred slightly and then allowed to settle. When the water has cleanly separated from the methyl ester vegetable oil, remove the water. This should be repeated until the discarded rinse water reaches ph level of 6–7.

If the liquid is cloudy, there is water being retained in the methylester vegetable oil, and it can be reheated slowly to evaporate out the water. Any white substances forming at the bottom or any bubbles forming at the surface are a sign of soaps and should be removed and the liquid should be rewashed.

Sheets with microencapsulated chromogene and oil combinations were coupled with a CF sheet coated with a zinc-modified phenolic resin CF or silton clay CF and imaged in a Typewriter Intensity (TI) test. Results of the TI test in Table 2 and 4 were measured in Kubelka-Munk (K-M) units which expresses print intensity in terms of the quantity of color present in each image. Use of the K-M unit as a means of determining the quantity of color present is discussed in TAPPI, Paper Trade J., pages 13–38, Dec. 21, 1939. The calculations and use of these functions are also described by Dr. G. Kortun et al. in Angewandte Chemie, International Edition, 2, pp. 333–341 (1963). The tables summarize the results.

The procedure for conducting print speed (PS) test or typewriter intensity (TI) test are as follows. A sample of CB "coated back", which is a sheet coated with microcapsulated chromogene and oil internal phase solvent, is mated with a sample of CF paper so that the CB and CF surfaces contact each other making a 2-ply form. This 2-ply form is then fed into an electric typewriter, containing no ribbon, so that the back of the CB sheet faces the ribbon carrier assembly. Two blocks, each measuring 22 mm×23 mm, are then typed so that an image is formed on the face of the CF where the CB capsules have been ruptured by the type head. For the purposes of this test, the blocks were printed using an electronic typewriter (Swintec model 7003) to maintain uniformity in size of the block, impact pressure, and time required to print the block. After the blocks have been typed, the 2-ply form is immediately removed from the typewriter.

In a TI test, the 2-ply form is left intact and placed under 241.4 gram mass for two minutes. At 2 minutes, the weight is removed and the plies are separated. The CF image is then read immediately after separation using a Technidyne (model BNL3) Opacimeter. One reading is made of each block, for a total of two readings per sheet. Another reading is made at 24 hours.

In a PS test, the 2-ply form is immediately separated and the CF image is read using a Technidyne (model BNL3) Opacimeter 30 seconds after separation. One reading is made of each block, for a total of two readings per sheet.

The Opacimeter produces a value that is the average of the two image intensities divided by the background intensity times 100. When using this instrument, the lower the number, the darker, or more intense, the image.

TABLE 4

| Example | % Paraffinic Hydrocarbon | % Canola Oil Methylester | % Soybean Oil | CF Material | Typewriter Intensity (TI) 2 Minute | Typewriter Intensity (TI) 24 Hour | % Ultimate KM | Print Speed (PS) 30 Second | Print Speed (PS) 24 Hour | % Ultimate K.M. |
|---|---|---|---|---|---|---|---|---|---|---|
| #2 | 30 | 40 | 30 | Clay | 46.8 | 39.9 | 66.8 | 51.6 | 41.9 | 56.4 |
| Comp. #3 | 30 | 70 | 0 | Clay | 48.9 | 41.5 | 64.8 | 53.0 | 42.9 | 54.7 |
| Comp. #4 | 0 | 40 | 60 | Clay | 52.3 | 42.4 | 55.6 | 55.9 | 43.7 | 47.9 |
| Comp. #5 | 0 | 70 | 30 | Clay | 48.0 | 38.6 | 57.7 | 52.4 | 40.2 | 48.6 |

Table 4 illustrates that the presence of the paraffinic hydrocarbon in the system improves the print speed of the system. The % Ultimate K.M. (Kubelka-Munk) number is a ratio of the two readings for each test and represents the amount of the final image (24 Hour) that is formed at either 2 minutes or 30 seconds, with a higher number indicating that more of the image is formed at the earlier time. In both the TI and PS tests, the presence of the paraffinic hydrocarbon resulted in a higher % ultimate K.M.

TABLE 5

| Example | % Paraffinic Hydrocarbon | % Canola Oil Methylester | % Soybean Oil | CF Material | Typewriter Intensity (TI) 2 Minute | Typewriter Intensity (TI) 24 Hour | Print Speed (PS) 30 Second | Print Speed (PS) 24 Hour |
|---|---|---|---|---|---|---|---|---|
| #6 | 5.0 | 47.5 | 47.5 | Clay | 55.7 | 45.0 | 57.1 | 43.6 |
| #7 | 5.0 | 47.5 | 47.5 | Resin | 47.9 | 39.9 | 60.0 | 39.8 |

| Example | % Paraffinic Hydrocarbon | % Sec-Butylbiphenyl | CF Material | Typewriter Intensity (TI) 2 Minute | Typewriter Intensity (TI) 24 Hour | Print Speed (PS) 30 Second | Print Speed (PS) 24 Hour |
|---|---|---|---|---|---|---|---|
| Comp. #8 | 55.0 | 45.0 | Clay | 52.7 | 49.6 | 56.6 | 50.6 |
| Comp. #9 | 55.0 | 45.0 | Resin | 46.0 | 46.2 | 51.2 | 47.8 |

Table 5 illustrates that by comparing final image intensities, the capsules made with the vegetable oil, vegetable oil esters and paraffinic hydrocarbon produce a more intense final image, compared to commercially available carbonless paper. All readings were made using a BNL Opacimeter where the lower the value obtained, the darker, or more intense, is the image.

Table 5 illustrates comparisons of the capsule solvent system of the invention on different CF (coated front) developer sheets of silton clays and phenolic resins.

Comparative Examples 8 and 9 are commercial CB (coated back) sold under the XERO/FORM® brand. XERO/FORM is a registered trademark of Appleton Papers Inc. Ultimate intensity as reflected in the 24 hour readings consistently improved with capsule systems according to the invention. Papers with capsule systems according to the invention were found to also have noticeably reduced odor characteristics at temperatures characteristic of machine operating conditions.

TABLE 6

| | Bond | Conventional CB | Soybean oil, Canola oil Methylester CB |
|---|---|---|---|
| Relative Measurable Volatiles | .05 | 1 | .43 |

Odor emissions testing was conducted in an environmental chamber using a commercial laser printer running the printer after reaching steady state operating temperatures and calculating measurable volatiles over an hour time period. The soybean oil and canola oil methyl ester capsule system had less than half the detectable odor based on relative measurable volatiles.

The principles, preferred embodiments, and modes of operation of the present invention have been described in the foregoing specification. The invention which is intended to be protected herein, however, is not to be construed as limited to the particular forms disclosed, since these are to be regarded as illustrative rather that restrictive. Variations and changes can be made by those skilled in the art without departing from the spirit and scope of the invention.

We claim:

1. A pressure sensitive record material for use in reprographic equipment comprising:

a sheet support carrying a pressure rupturable barrier comprising microcapsules containing an oil solution with dissolved chromogenic material, and, on either surface of the same sheet or on a different sheet support, a coating of an acidic developer material effective to develop the color of the chromogenic material in solution on contact therewith, wherein the pressure rupturable barrier comprises microcapsules having a wall material formed from polymerization of melamine and formaldehyde, methylol melamine, methylated methylol melamine, urea and formaldehyde, dimethylol urea or methylated dimethylol urea, with a copolymer of acrylic acid and alkyl acrylate, wherein the oil solution comprises a blend of (i) a vegetable oil having a degree of unsaturation greater than 30% and (ii) alkyl esters of fatty acids derived from transesterification of vegetable oil, and (iii) straight chain saturated paraffinic aliphatic hydrocarbons comprising from 0.5 to 70 weight percent of the oil solution.

2. The pressure sensitive record material according to claim 1 wherein the alkyl ester is a methyl ester.

3. The pressure sensitive record material of claim 1 wherein the acidic developer material comprises an inorganic acidic mineral.

4. The pressure sensitive record material of claim 3 wherein the acidic developer material is selected from silton clay, attapulgite, hallosyte, kaolin and colloidal silica.

5. The pressure sensitive record material of claim 1 wherein the acidic developer material comprises a phenolic based reactive material.

6. The pressure sensitive record material according to claim 1 wherein in the alkyl acrylate, the alkyl moiety is from one to eight carbons.

7. The pressure sensitive record material of claim 1 wherein the alkyl acrylate is selected from methyl acrylate, ethyl acrylate, propyl acrylate, butyl acrylate, pentyl acrylate, hexyl acrylate, or cyclohexyl acrylate.

8. The pressure sensitive record material of claim 1 wherein the chromogenic material includes at least one chromogene selected from 2-anilino-3-methyl-6-dibutylaminofluoran, 3-diethylamino-6-methyl-7-(2,4-dimethylphenyl)aminoflouran, crystal violet lactone, and 6'-[ethyl(3-methylbutyl)amino]-3'-methyl-2'-phenylamino)-spiro[isobenzofuran-1(3H),9'-[9H]xanthen]-3-one.

9. The pressure sensitive record material according to claim 1 wherein the oil solution blend is comprised of vegetable oil at 10 to 70 weight percent, and alkyl esters of fatty acids at 20 to 80 weight percent.

10. The pressure sensitive record material according to claim 1 wherein the chromogenic material is dissolved in the oil solution at less than about 100° C.

11. The pressure sensitive record material of claim 1 where in the chromogenic material is selected from one or more of 2-anilino-3-methyl-6-dibutyl aminoflouran, 6'-[ethyl(3-methylbutyl)amino]-3'-methyl-2'-(phenylamino)-spiro[isobenzofuran-1(3H), 9'-[9H]xanthen]-3-one, 3'-chloro-6'-cyclohexylamino-spiro [isobenzofuran-1(3H), 9'-[9H]xanthen]-3-one and 3-diethylamino-6-methyl-7-(2,4-dimethyl phenyl)aminoflouran.

12. The pressure sensitive record material according to claim 11 wherein the chromogenic material is dissolved in the methyl ester of the oil solution at less than 100° C.

13. A pressure sensitive record material suitable for use in reprographic equipment comprising:

a sheet support carrying a pressure rupturable barrier comprising microcapsules of an oil solution with dissolved chromogenic material, and, on either surface of the same sheet or on a different sheet support, a coating of an acidic developer material effective to develop the color of the chromogenic material in solution on contact therewith, wherein the pressure rupturable barrier comprises microcapsules having a wall material formed from polymerization of melamine and formaldehyde, methylol melamine methylated methylol melamine, urea and formaldehyde, dimethylol urea or methylated dimethylol urea, with a copolymer of acrylic acid and alkyl acrylate, wherein the oil solution comprises a blend of (i) a vegetable oil having a degree of unsaturation greater than 30% and comprised substantially of fatty acids of from 14 to 18 carbons, with (ii) methyl esters of fatty acids derived from transesterification of the same or different vegetable oil, and (iii) straight chain saturated paraffinic aliphatic hydrocarbons of from 10 to 13 carbons.

14. The pressure sensitive record material of claim 13 wherein the acidic developer material comprises an inorganic acidic mineral or phenolic based reactive material.

15. The pressure sensitive record material of claim 13 wherein the acidic developer material is selected from silton clay, attapulgite, hallosyte, kaolin and colloidal silica.

16. The pressure sensitive record material of claim 13 wherein the vegetable oil is each vegetable oil is independently selected from selected from canola oil, soybean oil, corn oil, sunflower oil, or cottonseed oil.

17. The pressure sensitive record material according to claim 13 wherein in the alkyl acrylate, the alkyl moiety is from one to eight carbons.

18. The pressure sensitive record material of claim 13 wherein the alkyl acrylate is selected from methyl acrylate, ethyl acrylate, propyl acrylate, butyl acrylate, pentyl acrylate, hexyl acrylate, or cyclohexyl acrylate.

19. The pressure sensitive record material of claim 13 wherein the chromogenic material includes at least one chromogene selected from 2-anilino-3-methyl-6-dibutylaminofluoran, 3-diethylamino-6-methyl-7-(2,4-dimethylphenyl)aminoflouran, crystal violet lactone, and 6'-[ethyl(3-methylbutyl)amino]-3'-methyl-2'-phenylamino) spiro[isobenzofuran-1(3H),9'-[9H]xanthen]-3-one.

20. The pressure sensitive record material according to claim 13 wherein the oil solution blend is comprised of vegetable oil at 10 to 70 weight percent, methyl ester of fatty acids at 20 to 80 weight percent, and the paraffinic hydrocarbons at from 0.5 to 70 weight percent.

21. The pressure sensitive record material according to claim 13 wherein the chromogenic material is dissolved in the oil solution at less than about 100° C.

* * * * *